US005662164A

United States Patent [19]

Nishishita

[11] Patent Number: 5,662,164

[45] Date of Patent: *Sep. 2, 1997

[54] LAMINATED HEAT EXCHANGER

[75] Inventor: Kunihiko Nishishita, Konan, Japan

[73] Assignee: Zexel Corporation, Tokyo, Japan

[ * ] Notice: The term of this patent shall not extend beyond the expiration date of Pat. No. 5,511,611.

[21] Appl. No.: 425,064

[22] Filed: Apr. 19, 1995

[30] Foreign Application Priority Data

Apr. 21, 1994 [JP] Japan ..... 6-106089

[51] Int. Cl.[6] ..... F28D 1/03

[52] U.S. Cl. ..... 165/153; 165/176

[58] Field of Search ..... 165/153, 176; 62/515

[56] References Cited

U.S. PATENT DOCUMENTS

| | | | |
|---|---|---|---|
| 4,217,953 | 8/1980 | Sonoda et al. | 165/153 X |
| 4,274,482 | 6/1981 | Sonoda | 165/153 |
| 4,621,685 | 11/1986 | Nozawa | 165/153 X |
| 4,867,486 | 9/1989 | Fukata et al. | 165/176 X |
| 5,024,269 | 6/1991 | Noguchi et al. | 165/153 |
| 5,431,217 | 7/1995 | Kadle et al. | 165/153 |
| 5,511,611 | 4/1996 | Nishishita | 165/153 |

FOREIGN PATENT DOCUMENTS

| | | | |
|---|---|---|---|
| 55596 | 3/1986 | Japan | 165/153 |

*Primary Examiner*—Leonard R. Leo
*Attorney, Agent, or Firm*—Wenderoth, Lind & Ponack

[57] ABSTRACT

In a laminated heat exchanger, tube elements through which heat exchanging medium does not easily flow are eliminated by partitioning one of two tank groups extending in a direction of lamination approximately at the middle to divide it into a first communicating area 22 and a second communicating area 23. The first communicating area 22 communicates with an intake port 20 though which coolant flows in. The second communicating area 23 communicates with an outlet port 21 through which the coolant flows out. The number of tube elements constituting the first communicating area 22 is greater than the number of tube elements constituting the second communicating area 23. In this 4-pass system laminated heat exchanger, inconsistency in temperature distribution is minimized to achieve an improvement in heat exchanging performance.

8 Claims, 5 Drawing Sheets

LAMINATED HEAT EXCHANGER

BACKGROUND OF THE INVENTION

1. Field of the Invention

The present invention relates to a laminated heat exchanger used for the cooling cycle and the like of an air conditioning system for vehicles, constituted by laminating tube elements and fins alternately over a plurality of levels and, in particular, it relates to a laminated heat exchanger that employs the so-called 4-pass system, with each tube element being provided with a pair of tanks formed on one side (i.e. at one longitudinal end) so that heat exchanging medium passes through the tube element on two round-trips as it travels from the intake port to the outlet port.

2. Description of the Related Art

The so-called 4-pass system laminated heat exchanger is constituted, as disclosed in Japanese Unexamined Patent Publication No. S63-3153, for instance, by laminating tube elements and fins alternately over a plurality of levels with each tube element being provided with a pair of tanks on one side. The two tanks in this pair communicate with each other via a U-shaped passage and the tank portions in adjacent tube elements are bonded so as to form two tank groups extending in the direction of the lamination. One of the tank groups is partitioned in the middle to divide the inside into two communicating areas and, as shown in FIG. 7, an intake port 20 is provided in one of the communicating areas 22 and an outlet port 21 is provided in the other communicating area 23. Thus, the heat exchanging medium that flows in through the intake port 20 travels through the first and second passes which are constituted by the tube elements located toward the intake port from the partitioning portion. It then travels through the third and fourth passes which are constituted by the tube elements located toward the outlet port from the partitioning portion to flow out through the outlet pert 21.

However, if the heat exchanging medium used is a coolant, the coolant becomes gradually gassified during the process of heat exchanging and expands. Therefore, in the 4-pass system heat exchangers of the prior art, in order to secure enough cross-sectional area in the passage, fewer tube elements are located toward the intake port from partitioning portion than toward the outlet port. However, from research conducted by this inventor, it has been learned that if the outlet port for heat exchanging medium is provided at one end in the direction of lamination of the tube elements, the temperature of the tube elements in the vicinity of the partitioning portion (the tube elements separated from the outlet port 21 that constitute area B in FIG. 7) among the tube elements constituting the third and fourth passes, increases. As a result, an even temperature distribution over the entire heat exchanger cannot be achieved. This is because when identical tube elements are used for lamination, heat exchanging medium mainly flows through the tube elements nearest the outlet port and it does not easily flow through the tube elements around the partitioning portion.

SUMMARY OF THE INVENTION

Accordingly, an object to the present invention is to provide a laminated heat exchanger which minimizes the inconsistency in temperature distribution to achieve a further improvement in heat exchanger performance.

This inventor has learned that since heat exchanging medium does not flow efficiently through the tube elements furthest from the outlet pert of all the tube elements constituting the third and fourth passes, it would make sense to use those tube elements far away from the outlet port to constitute the first and second passes for improved efficiency and based upon this observation, this inventor has completed the present invention.

The heat exchanger according to the present invention is constituted by laminating tube elements and fins alternately over a plurality of levels with each tube element being provided with a pair of tanks on one side and the two tanks in this pair of tanks communicating with each other via a U-shaped passage and by bonding the tank portions in adjacent tube elements to form two tank groups extending in the direction of the lamination. One of the tank groups is partitioned in the middle to divide the inside into a first communicating area and a second communicating area. The other tank group has no partitioning portion and communicates straight through. In intake port and an outlet port through which the heat exchanging medium flows in and out respectively are formed at the end toward the second communicating area in the direction of the lamination, with the intake port communicating with the first communicating area and the outlet port communicating with the second communicating area. The number of tube elements constituting the first communicating area is greater than the number of tube elements constituting the second communicating area.

Consequently, the heat exchanging medium flowing in through the intake port enters the first communicating area formed in one tank group and then it travels through the U-shaped passages of the tube elements constituting the first communicating area to be induced into the other tank group. After moving through the other tank group, the heat exchanging medium travels through the U-shaped passages of the tube elements constituting the second communicating area to reach the second communicating area and then it flows out through the outlet port.

During this process, since the second communicating area is made smaller than the first communicating area, the heat exchanging medium is distributed almost evenly throughout all the tube elements constituting the second communicating area, reducing inconsistency in temperature distribution.

BRIEF DESCRIPTION OF THE DRAWINGS

The above and other features of the invention and the concomitant advantages will be better understood and appreciated by persons skilled in the field to which the invention pertains in view of the following description given in conjunction with the accompanying drawings which illustrate preferred embodiments. In the drawings:

FIG. 1B is a bottom view of the heat exchanger;

DETAILED DESCRIPTION OF THE PREFERRED EMBODIMENT

The following is an explanation of an embodiment of the present invention in reference to the drawings.

Figure 1A:
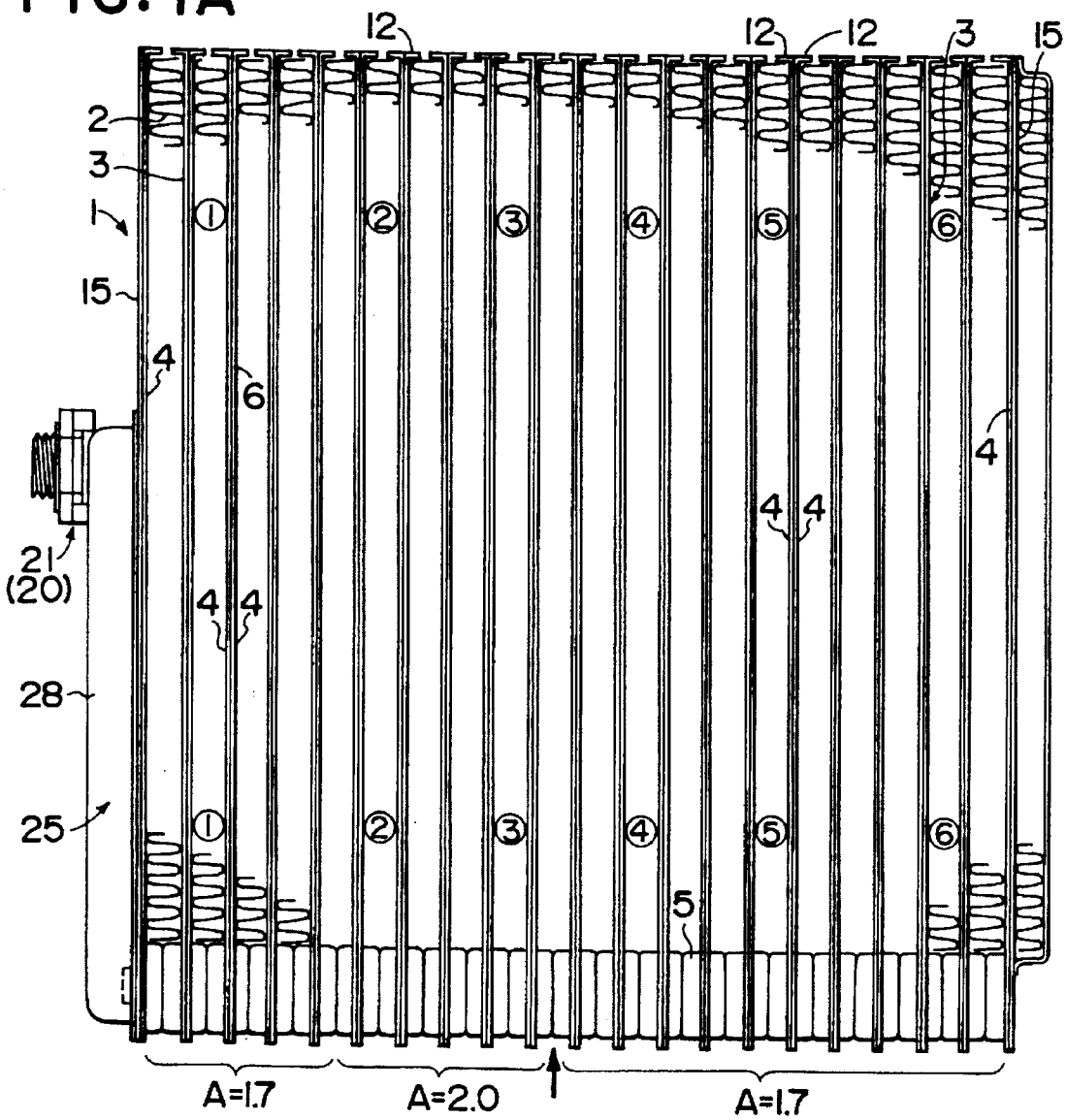
FIGS. 1A and 1B show an embodiment of the laminated heat exchanger according to the present invention, in which FIG. 1A and is a front elevation
Figure 1B:
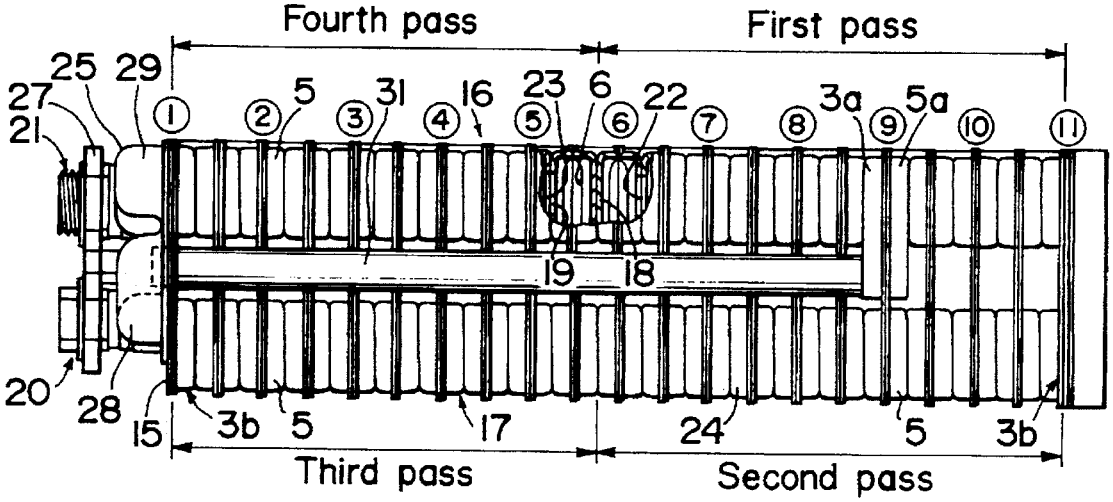

In FIGS. 1A and 1B, laminated heat exchanger 1 is, for instance, a 4-pass system evaporator that is constituted by laminating fins 2 alternately with tube elements 3 over a plurality of levels and is provided with an intake port and an outlet pert for heat exchanging medium at one end in the direction of the lamination. A typical tube element 3 is formed by bonding two formed plates 4, 4 at their peripheral edges and is provided with two tanks 5, 5 on one side(i.e. at one longitudinal end) and a U-shaped passage 6 which conducts the heat exchanging medium from the tanks 5 to the other end.

Figure 2:
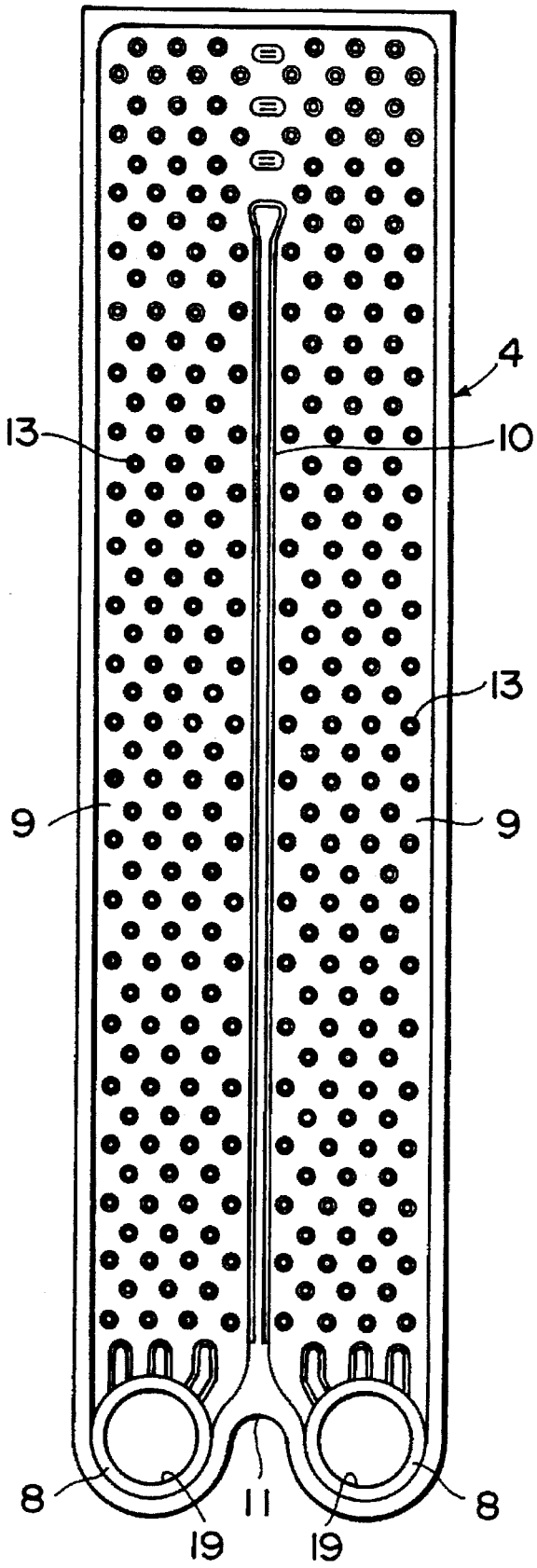
FIG. 2 is a front elevation of a tube element used in the laminated heat exchanger in FIG. 1.

A formed plate 4 is formed by pressing an aluminum plate and, as shown in FIG. 2, it has two bowl-shaped distended portions for tank formation (i.e. a distended passage portion) 8, 8 at one end and contiguous with them, a distended portion for passage formation (i.e. distended passage portion) 9 is formed. A projection 10 is formed in the distended portion for passage formation 9, which extends from between the distended portions for tank formation 8, 8 to the vicinity of the other end of the formed plate 4. Also, an indented portion 11 for accommodating a communicating pipe, which is to be explained later, is provided between the two distended portions for tank formation 8, 8. At the other end of the formed plate 4, a projected tab 12 (shown in FIGS. 1A and 1B) for preventing the fins 2 from coming out during assembly prior to brazing is provided.

The distended portions for tank formation 8 distend further than the distended portions for passage formation 9. Also, the projection 10 is formed in such a manner that it lies on the same plane as the bonding margin at the peripheral edges of the formed plate. Consequently, when two formed plates 4 are bonded on their peripheral edges, their projections 10, too, become bonded so that a pair of tanks 5, 5 are constituted with the distended portions for tank formation 8 which face opposite each other and also that a U-shaped passage 6 which communicates between the tanks is constituted with distended portions for tank formation 8 that face opposite each other.

In addition, a plurality of beads 13 are formed at the time of pressing in order to improve the efficiency with which heat exchanging is performed. When two formed plates 4, are bonded, each bead 13 becomes bonded with the bead formed at the position facing opposite. Such beads 13, may be formed in any shape as long as they are rounded, i.e., they can be oval, polygonal or the like. However, if too many beads are provided, it will increase the passage resistance in the U-shaped passage 6. Therefore, they should be formed at a suitable density. The beads 13 are formed, as shown in FIG. 2, for instance, as a plurality of bead rows which run at a right angle to the direction of the length of the tube elements 3 with the number of beads differing in adjacent bead rows. In other words, if there are three beads 13 provided at specific intervals in row n, there will be 4 beads 13 provided at the same intervals in row n+1, with 3 beads provided in row n+2 and so forth.

Furthermore, each bead 13 in adjacent bead rows is positioned in such a manner that it will not lie in the wake of the preceding bead in the direction of the length of the tube elements 3 (the vertical direction in the figure). In this embodiment, they are positioned in such a manner that the bead 13 that is the closest to a given bead 13 in the adjacent row, is positioned at an angle of 30x relative to the direction of the length of the tube element 3.

A tube element **3*a*, located at a specific position toward one side from the center, is not provided with the mounting indented portion 11 described earlier and one of its tanks 5*a* is extended to be close to and in contact with its other tank 5. In addition, the tube elements 3*b* at the two ends are each formed by bonding a flat plate 15 to the formed plate 4 shown in FIG. 2**.

Adjacent tube elements 3 are butted at the distended portions for tank formation 8 of their respective formed plates 4, and two tank groups 16 and 17, first and second tank groups which extend in the direction of the lamination (the direction that runs at a right angle to the direction of air flow) are formed. In one of these tank groups, namely the tank group 16, which includes the extended tank **5*a*, all tanks are in communication via the communicating holes 19 formed at the distended portions for tank formation 8 except for at a partitioning portion 18 that is located approximately at the center in the direction of lamination. In the other tank group 17, there is no partitioning portion and all the tanks are in communication via the communicating holes 19**.

In this embodiment, a total of 21 tube elements are laminated. The tube element **3*a* with the extended tank 5*a* is located at the 17th position counting from the end where an intake port 20 and an outlet port 21, which are to be explained below, are formed, and the partitioning portion 18 is provided in the area where the 10th and 11th tube elements 3 counting from the end where the intake port 20 and the outlet port 21 are formed, are bonded. The partitioning portion 18** may constituted either by not forming a communicating hole in one of or both of the formed plates to be bonded or by using formed plates identical to the other formed plates but with the communicating hole blocked off by a blind plate when bonding them.

Consequently, the first tank group 16, with the partitioning portion 18, is divided into a first communicating area 22 which includes the extended tank **5*a* and a second communicating area 23, located between the outlet port 21 and the first communicating area 22, communicating directly with the outlet port 21, while the second tank group 17, with no partition, constitutes a third communicating area 24 with 21 tanks 5** in communication.

Figure 3:
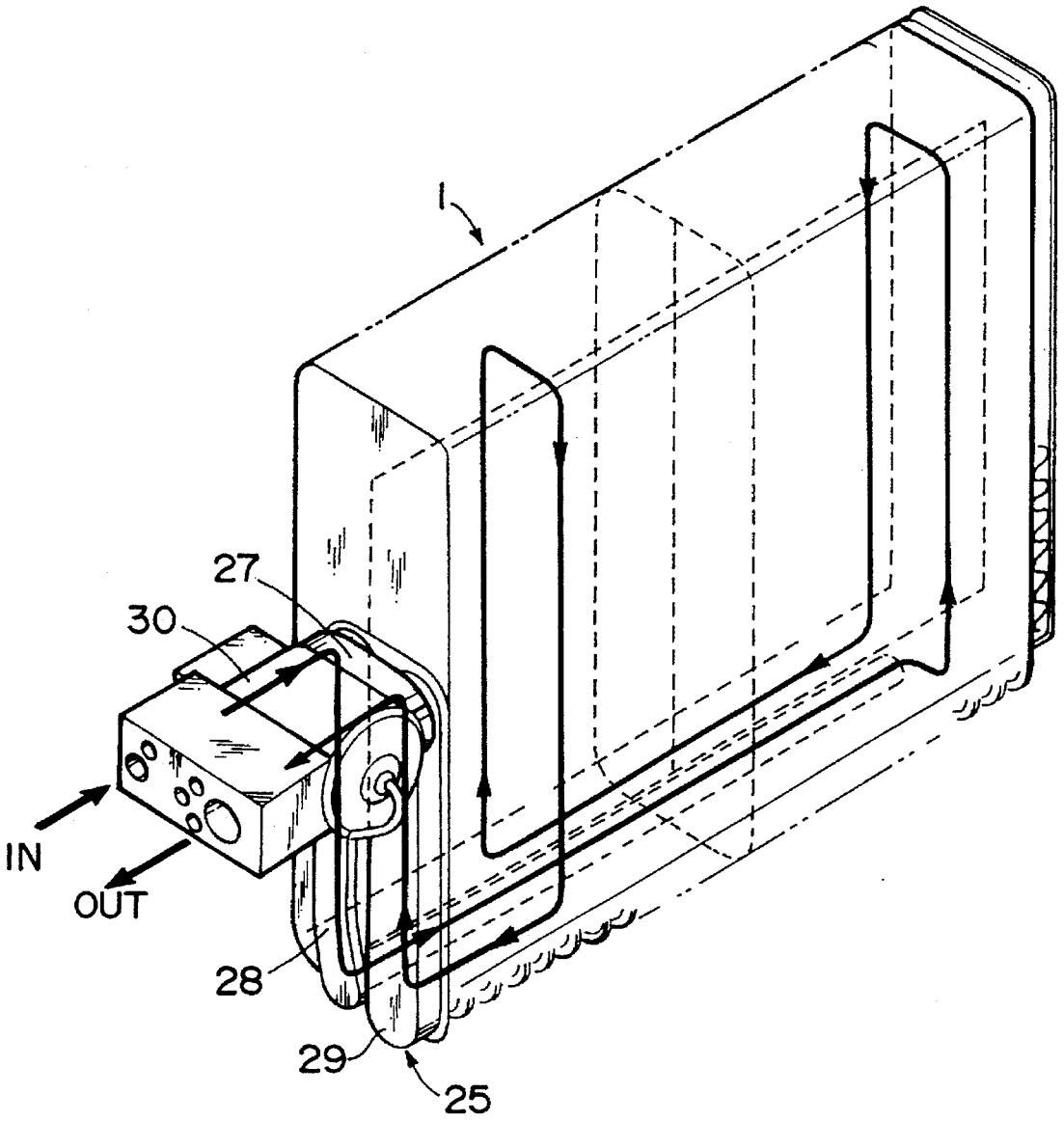
FIG. 3 illustrates the flow of heat exchanging medium in the laminated heat exchanger in FIGS. 1A and 1B.

The intake port 20 and the outlet port 21, which are provided at the end furthest from the extended tank **5*b* are constituted by bonding a plate for intake/outlet passage formation 25 to the flat plate 15 from the outside, forming an intake passage 28 and an outlet passage 29 extending from approximately the middle of the tube elements 3 in the direction of the length toward the tanks and providing a connecting portion 27 for connecting an expansion valve 30 (shown in FIG. 3) at the plate for intake/outlet passage formation 25**.

The intake passage 28 and the extended tank **5*a* are connected by a communicating pipe 31, which is fitted in the indented portions 11 of the tube elements 3, located between them in such a manner that they can communicate, while the second communicating area 23 and the outlet passage 29 beside it communicate with each other via the through-hole formed in the flat plate 15**.

As a result, the heat exchanging medium flowing in through the intake port 20 travels through the communicating pipe 31 to enter the tube element 3*a* with the extended tank 5*a*. Then it is distributed throughout the entirety of the first communicating area 22. It then rises through the U-shaped passages 6 of the tube elements that belong to this first communicating area 22 along the projections 10 (first pass). Next, it makes a U-turn above the projections 10 and flows to down (second pass) and to reach the tank group on the opposite side (third communicating area 24). After this, the heat exchanging medium moves horizontally to the remaining tube elements that constitute the third communicating area and flows up through the U-shaped passages 6 of the tube elements, along their projections 10 (third pass). It then makes a U-turn above the projections 10 and goes down (fourth pass) to be led to the tanks that constitute the second communicating area 23. After that, the heating exchanging medium flows out through the outlet port 21 (refer to the flow pattern illustrated in FIG. 3). Because of this, the heat in the heat exchanging medium is communicated to the fins 2 during the process in which it flows through the U-shaped passages constituting the first pass through the fourth pass, and exchange of heat with the air passing between the fins is performed.

Since the second communicating area 23 communicates with the outlet port 21 at one end in the direction of lamination, the heat exchanging medium which travels through the third and fourth passes to reach the second communicating area 23 would tend to flow through the tube elements close to the outlet port 21. However, as the position of the partitioning portion is closer to the outlet port so that the number of tube elements constituting the first communicating area is greater than the number of tube elements constituting the second communicating area, the heat exchanging medium is distributed almost consistently throughout all the tube elements.

Figure 4A:
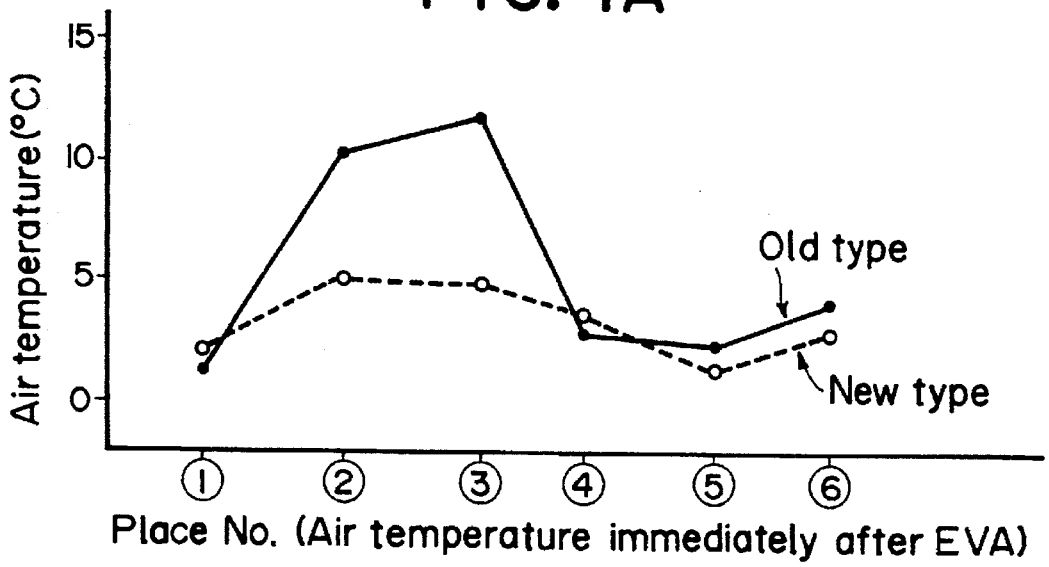
FIGS. 4A and 4B show the air temperature immediately after passing through the laminated heat exchanger shown in FIGS. 1A and 1B, FIG. 4A being a chart showing the air temperature which has passed the upper portion of the heat exchanger and FIG. 4B being a chart showing the air temperature which has passed the lower portion of the heat exchanger.
Figure 4B:
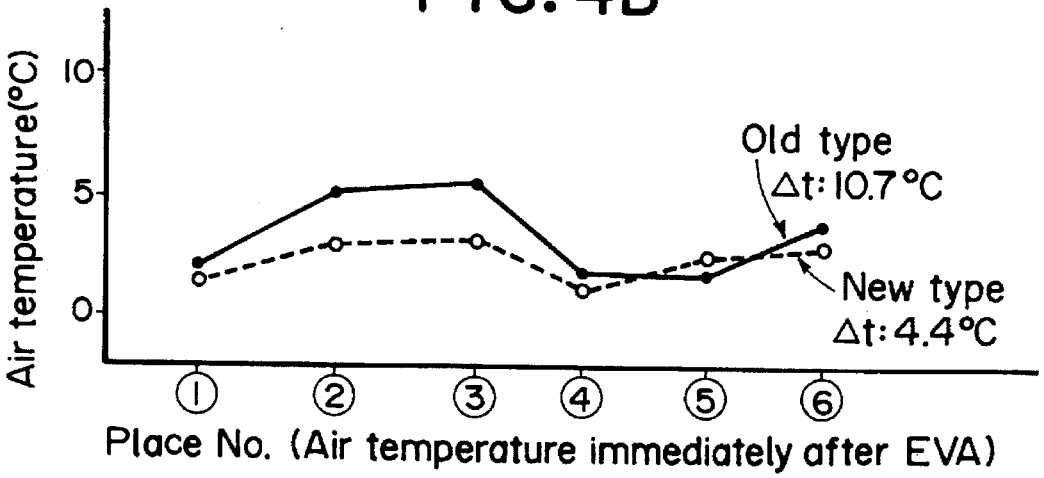
Figure 5:
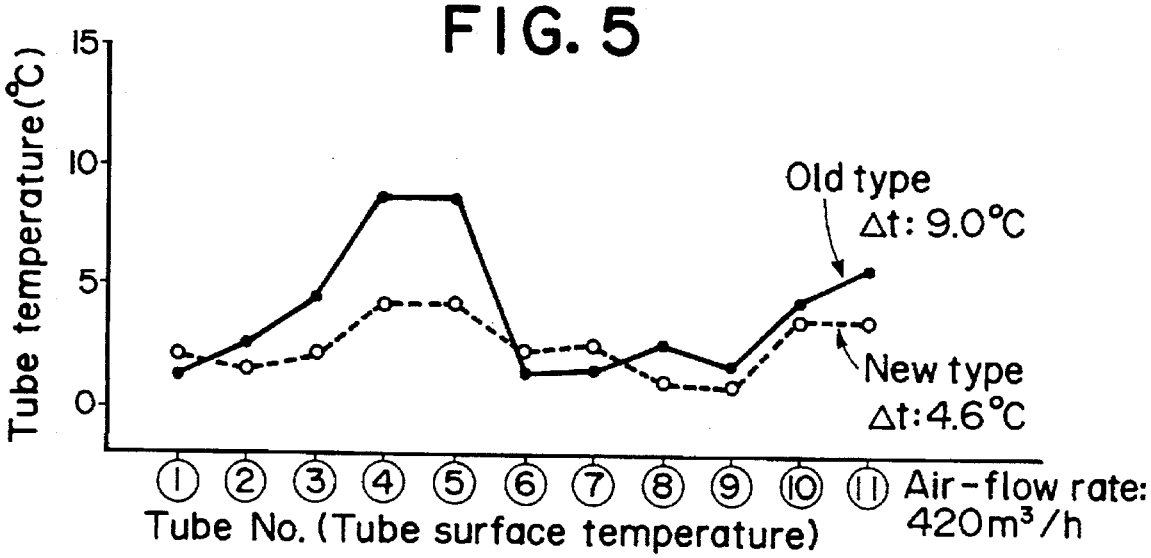
FIG. 5 is a chart of the surface temperature of a tube element.
Figure 6:
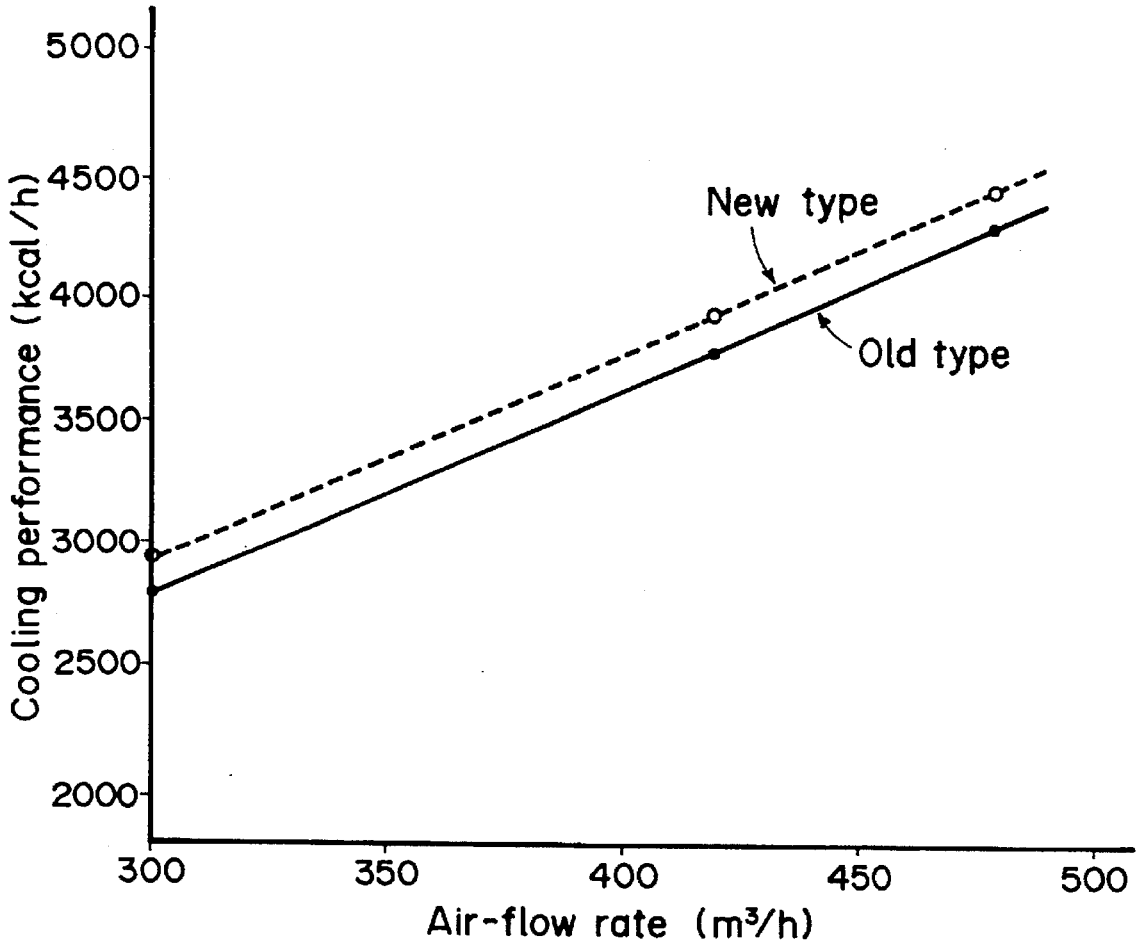
FIG. 6 is a characteristics diagram indicating the cooling performance relative to air flow rate.
Figure 7:
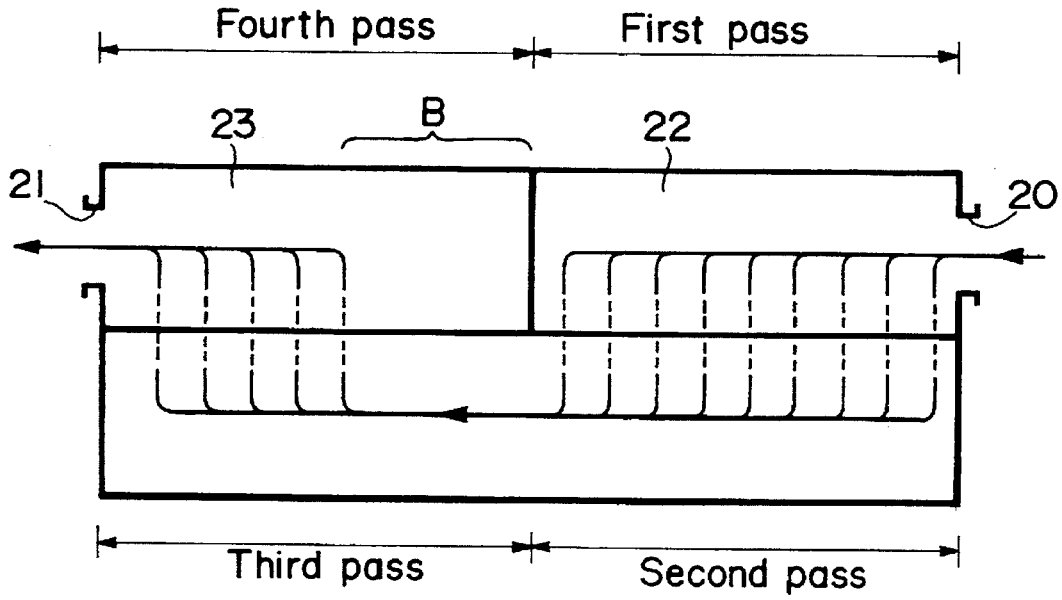
FIG. 7 illustrates the flow of heat exchanging medium in a laminated heat exchanger in the prior art.

FIGS. 4A, 4B, 5 and 6 show a comparison between a new type of heat exchanger structured as described above, and an old type of heat exchanger which has its partitioning portion 18 provided in the area where the twelfth and thirteenth tube elements 3 counting from the end where the intake port 20 and the outlet port 21 are formed. In FIGS. 4A and 4B, the numbers above PLACE—No. indicate the locations where the temperature of the air immediately after it passes through the heat exchanger was measured and they correspond to the numbers ①~⑥ in the upper portion and ①~⑥ in the lower portion shown in FIG. 1A. In FIG. 5, the numbers above TUBE—No. indicate the tube elements whose surface temperature was measured and they correspond with the numbers ①~⑪(①, ②, ③, . . . ) shown in FIG. 1B. Δt indicates the deviation in temperature distribution, i.e., the difference between the maximum temperature and the minimum temperature for each type. In particular, FIGS. 4A, 4B show the differences between the maximum and minimum temperatures measured at a total of 12 locations in the upper and lower areas.

As is obvious from these results, in the old type of heat exchanger, the temperature of the air passing in the vicinity of the partitioning portion of the tube elements constituting the third and fourth passes and the temperature of the tube elements themselves in that particular area are especially high. In the new type; although there is actually a slight increase in temperature in that area, the inconsistency in temperature distribution is greatly reduced and the heat exchanging medium is distributed almost evenly for heat exchanging. An evaluation based upon Δt shows that the consistency is improved by approximately 60% in the new type compared to the old type. This improvement brings about an overall improvement of approximately 5% in the cooling performance of the heat exchanger.

Note that the position of the partitioning portion may change depending upon the number of laminated layers in the heat exchanger, and it should be determined by, for instance, measuring actual temperature distribution. However, it is desirable to set this position so that the ratio of the number of the tube elements constituting the first communicating area and that of the tube elements constituting the second communicating area falls within a range of 1:1 through 3:1. We set the ratio at the limit 3:1, since if the partitioning portion 18 is placed any closer to the outlet port 21, the second communicating area is reduced, resulting in an increase in the passage resistance and lowered heat exchanging performance.

Furthermore, while the explanation has been given on the tube elements as used in an evaporator, it is obvious that other laminated heat exchangers may be constituted under identical conditions. In such a case, too, inconsistency in temperature distribution can be reduced and an improvement in the cooling performance can be achieved. In addition, the embodiment takes a form in which tanks are formed as one with the tube elements. However, they can be constituted with separate members.

As has been explained, according to the present invention, since the number of the tube elements constituting the first communicating area is larger than that of the tube elements constituting the second communicating area, the heat exchanging medium is distributed almost consistently throughout individual tube elements, reducing inconsistency in temperature distribution overall and achieving an improvement in heat exchanging performance.

What is claimed is:

1. A heat exchanger constituted by laminating tube elements alternately with fins over a plurality of levels in a lamination direction, wherein each of said tube elements is provided with a pair of tanks at one end thereof, with said pair of tanks communicating with each other via a U-shaped passage, tanks in adjacent tube elements are connected to form a first tank group extending in the lamination direction and a second tank group extending in the lamination direction, said first tank group is partitioned along the lamination direction to divide said first tank group into a first communicating area at a first end of said heat exchanger and a second communicating area at a second end of said heat exchanger, said second tank group has no partitioning portion and communicates straight through, an intake port and an outlet port through which heat exchanging medium flows in and out respectively are formed at said second end of said heat exchanger with said intake port communicating with said first communicating area and said outlet port communicating with said second communicating area, said tube elements having said tanks constituting said first communicating area are greater in number than said tube elements having said tanks constituting said second communicating area, endmost ones of said tube elements at said first and second ends of said heat exchanger are constituted with flat plates, and said intake port and said outlet port are constituted by bonding a plate for intake/outlet passage formation to one of said flat plates, and by providing a connecting portion for connecting an expansion valve to said plate for intake/outlet passage formation.

2. A laminated heat exchanger according to claim 1 wherein 21 tube elements are laminated, and a partitioning portion is formed in said first tank group and blocks communication between the 10th and 11th tube elements, counting from said second end of said heat exchanger.

3. A laminated heat exchanger according to claim 2 wherein each of said tube elements is formed of a pair of formed plates bonded together; and said partitioning portion formed in said first tank group is constituted by not forming a communicating hole between said 10th and 11th tube elements in at least one of said formed plates thereof.

4. A laminated heat exchanger according to claim 2 wherein said partitioning portion formed in said first tank group is constituted by providing a blind plate between said 10th and 11th tube elements.

5. A laminated heat exchanger according to claim 1 wherein each tube element is constituted by bonding two formed plates at their peripheral edges.

6. A laminated heat exchanger according to claim 1 wherein said tube elements having said tanks constituting said first communicating area are greater in number by one tube element than said tube elements having said tanks constituting said second communicating area.

7. A heat exchanger constituted by laminating tube elements alternately with fins over a plurality of levels in a lamination direction, wherein each of said tube elements is provided with a pair of tanks at one end thereof, with said pair of tanks communicating with each other via a U-shaped passage, tanks in adjacent tube elements are connected to form a first tank group extending in the lamination direction and a second tank group extending in the lamination direction, said first tank group is partitioned along the lamination direction to divide said first tank group into a first communicating area at a first end of said heat exchanger and a second communicating area at a second end of said heat exchanger, said second tank group has no partitioning portion and communicates straight through, an intake port and an outlet port through which heat exchanging medium flows in and out respectively are formed at said second end of said heat exchanger with said intake port communicating with said first communicating area and said outlet port communicating with said second communicating area, said tube elements having said tanks constituting said first communicating area are greater in number than said tube elements having said tanks constituting said second communicating area, endmost ones of said tube elements at said first and second ends of said heat exchanger are constituted with flat plates, said intake port and said outlet port are constituted by bonding a plate for intake/outlet passage formation to one of said flat plates, and by providing a connecting portion for connecting an expansion valve to said plate for intake/outlet passage formation, said intake port and said first communicating area communicate with each other via a communicating pipe which is fitted in indented portions provided respectively at lower ends of said tube elements, and said outlet port and said second communicating area communicate with each other via a through hole formed in one of said flat plates.

8. A heat exchanger constituted by laminating tube elements alternately with fins over a plurality of levels in a lamination direction, wherein each of said tube elements is provided with a pair of tanks at one end thereof, with said pair of tanks communicating with each other via a U-shaped passage, tanks in adjacent tube elements are connected to form a first tank group extending in the lamination direction and a second tank group extending in the lamination direction, said first tank group is partitioned along the lamination direction to divide said first tank group into a first communicating area at a first end of said heat exchanger and a second communicating area at a second end of said heat exchanger, said second tank group has no partitioning portion and communicates straight through so as to constitute a third communicating area, an intake port and an outlet port through which heat exchanging medium flows in and out respectively are formed at said second end of said heat exchanger with said intake port communicating with said first communicating area and said outlet port communicating with said second communicating area, said tube elements having said tanks constituting said first communicating area are greater in number than said tube elements having said tanks constituting said second communicating area, endmost ones of said tube elements at said first and second ends of said heat exchanger are constituted with flat plates, said intake port and said outlet port are constituted by bonding a plate for intake/outlet passage formation to one of said flat plates, and by providing a connecting portion for connecting an expansion valve to said plate for intake/outlet passage formation, said intake port and said first communicating area communicate with each other via a communicating pipe which is fitted in indented portions provided respectively at lower ends of said tube elements, said outlet port and said second communicating area communicate with each other via a through hole formed in one of said fiat plates, and heat exchanging medium travels from said intake port through said communicating pipe to enter said first communicating area formed in said first tank group, passes through said U-shaped passages of said tube elements having said tanks of said first communicating area and reaches said third communicating area, then travels through said U-shaped passages of said tube elements having said tanks of said second communicating area, and is introduced into said second communicating area and finally, flows out through said outlet port.

* * * * *